US005861856A

United States Patent [19]

Beele et al.

[11] Patent Number: 5,861,856

[45] Date of Patent: Jan. 19, 1999

[54] AIRBORNE RADAR

[75] Inventors: Brian J Beele; Geoffrey Salkeld, both of Preston, United Kingdom

[73] Assignee: British Aerospace Public Limited Company, London, United Kingdom

[21] Appl. No.: 627,401

[22] Filed: Dec. 5, 1990

[30] Foreign Application Priority Data

Feb. 22, 1990 [GB] United Kingdom ..... 9004024

[51] Int. Cl.[6] ..... H01Q 1/28

[52] U.S. Cl. ..... 343/708

[58] Field of Search ..... 343/708, 705

[56] References Cited

U.S. PATENT DOCUMENTS

| | | | |
|---|---|---|---|
| 2,394,259 | 2/1946 | Perrine, Jr. | 343/705 |
| 2,495,748 | 1/1950 | Matson | 343/705 |
| 4,662,588 | 5/1987 | Henderson | 244/118.2 |
| 4,797,680 | 1/1989 | Smethers, Jr. | 343/705 |
| 4,896,160 | 1/1990 | Miller, Jr. | 343/708 |

FOREIGN PATENT DOCUMENTS

| | | |
|---|---|---|
| 901806 | 11/1953 | Germany . |
| 1536142 | 12/1978 | United Kingdom . |
| 2024522 | 1/1980 | United Kingdom . |

OTHER PUBLICATIONS

British Search Report.

*Primary Examiner*—Theodore M. Blum
*Attorney, Agent, or Firm*—Nixon & Vanderhye P.C.

[57] ABSTRACT

A radar for an aircraft (1) comprises end-plates (4*a*, 4*b*) mounted at the tip's of two pairs of aircraft wings (2*a*, 2*b*, 3*a*, 3*b*). Each end-plate carries a sideways-looking phased array (6) whose beam is unobstructed by aircraft structure. The array can be made to have a large area, thus producing a narrow beam, steerable over a large solid angle. In one embodiment, the end plates (4*a*, 4*b*) incorporate fins (5*a*, 5*b*) which replace the aircraft fin to afford lateral stability and control.

6 Claims, 1 Drawing Sheet

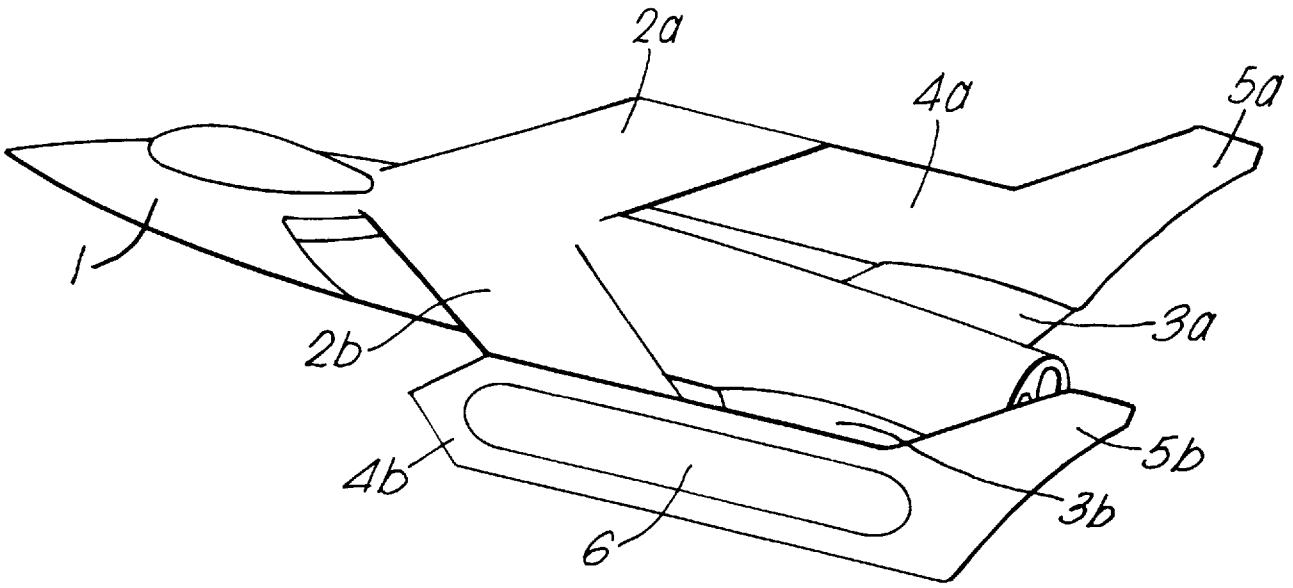
1
2a
2b
3a
3b
4a
4b
5a
5b
6

AIRBORNE RADAR

BACKGROUND OF THE INVENTION

1. Field of the Invention

This invention relates to airborne radar and is particularly applicable to military aircraft.

2. Discussion of Prior Art

Conventional airborne radars are usually mounted either in the nose of a fighter sized aircraft or within a rotordome on top of the fuselage of a large civil aircraft. Both configurations are severely affected by radar size restrictions and by obstruction of the transmitted and reflected radar beams by aircraft structure and by radomes associated with the radar.

These problems have been partially ameliorated by a configuration described in GB 2,024,522A which incorporates a loop antenna within an aerofoil. However, the radar beam is limited in size by the width of the aerofoil. U.S. Pat. No. 4,662,588 describes a disc-shaped structure incorporated within a fuselage and carrying a circular aperture phased array antenna. A disadvantage of this configuration is that the radar beam is obstructed to a certain extent by the aircraft structure. Furthermore this configuration is intended for unmanned aircraft and would be unsuitable for military aircraft.

SUMMARY OF THE INVENTION

Objects of the present invention are to provide a sideways looking radar antenna having a large surface area which can be incorporated with a small aircraft so that the radar beam is substantially unobstructed by the aircraft structure.

Accordingly, the present invention comprises an airframe having a wing and a wing extension running substantially parallel to the airframe fuselage and incorporating an antenna, insulated from the airframe and mounted on an outer surface of said wing extension facing outboard away from the airframe fuselage.

Preferably, the antenna is of the electronically-steerable phased-array type.

In a preferred embodiment, the airframe is fitted with one of said wing extensions at each wing tip.

The surfaces can be made to have a large area and therefore the antenna can be made large. This feature provides the possibility of producing a narrow beam which can be steered over a wide solid angle. A further advantage is that beams can be fired outwards, away from the fuselage, without being obstructed by any part of the aircraft's structure.

If the outer side of the wing extension is made to be flat, then a planar phased-array can be realised. This has the advantage, compared with conformal arrays (which may follow the contours of a wing or fuselage) that control of the beam direction is more predictable.

The invention, incorporating a phased array antenna, can be used to control a missile, for example. Because the array can be large, it can transmit significantly more power than conventional airborne radars and therefore is much more difficult to jam.

BRIEF DESCRIPTION OF THE DRAWINGS

An embodiment of the invention will now be described, by way of example only, with reference to the drawing which shows a perspective view of an aircraft in accordance with the invention.

DETAILED DISCUSSION OF PREFERRED EMBODIMENTS

An aircraft 1 has an upper pair 2*a*, 2*b* and a lower pair 3*a*, 3*b* of wings. One of each upper and lower pair are connected together by one of two end-plates 4*a*, 4*b*. The end-plates 4*a*, 4*b* incorporate rear fin portions 5*a*, 5*b* which replace the aircraft fin to afford lateral stability and control of the aircraft 1. The end-plates 4*a*, 4*b* also enhance the lift available from the two pairs of wings 2*a*, 2*b* and 3*a*, 3*b*. Each of the end-plates 4*a*, 4*b* is mounted on the wing tips and is substantially vertical to the plane of each wing and runs substantially parallel with the aircraft fuselage. The outboard-facing surfaces of each end-plate are flat and onto each surface is mounted an electronically-steered planar phased array antenna 6. The antenna is of conventional construction and is provided with a protective cover. An antenna of this size is capable of steering a beam over a range of ±60° in azimuth and elevation.

In an alternative embodiment, the aircraft has just one pair of wings, each carrying an end-plate with its associated antenna array.

We Claim:

1. An airframe having a fuselage, the airframe comprising:

at least one wing attached to said fuselage;

a wing extension, substantially parallel to said fuselage, attached to said at least one wing and having an outer surface; and a directional antenna mounted on said outer surface of said wing extension and facing in a direction away from the fuselage, wherein the airframe has one pair of wings and is fitted with two of said wing extensions, one wing extension mounted on each wing tip.

2. An airframe having a fuselage, the airframe comprising:

at least one wing attached to said fuselage;

a wing extension, substantially parallel to said fuselage, attached to said at least one wing and having an outer surface; and a directional antenna mounted on said outer surface of said wing extension and facing in a direction away from the fuselage, wherein the airframe has two pairs of wings, one wing of each pair being connected together at the wing tips by one of two said wing extensions.

3. An airframe having a fuselage, the airframe comprising:

at least one wing attached to said fuselage;

a wing extension, substantially parallel to said fuselage, attached to said at least one wing and having an outer surface; and a directional antenna mounted on said outer surface of said wing extension and facing in a direction away from the fuselage, wherein the antenna is an electronically-steerable phased array antenna.

4. An airframe having a fuselage, the airframe comprising:

at least one wing attached to said fuselage;

a wing extension, substantially parallel to said fuselage, attached to said at least one wing and having an outer surface; and a directional antenna mounted on said outer surface of said wing extension and facing in a direction away from the fuselage, wherein said outer surface is flat and said antenna is a planar phased-array antenna.

5. An airframe having a fuselage with at least two sides, the airframe comprising:

two pairs of wings, one wing of each pair attached to one side of said fuselage and the other wing of each pair attached to another side of said fuselage;

two wing extensions, one of said extensions located substantially parallel to said one side of said fuselage and the other of said extensions located substantially parallel to said another side of said fuselage, one of said extensions comprising a means for connecting together tips of said one wings of said pairs and the other of said extensions comprising a means for connecting together tips of said other wings of said pairs; and a directional antenna, mounted on an outer surface of at least one of said wing extensions, facing in a direction outboard away from said fuselage.

6. An airframe as claimed in claim 5 further including another directional antenna, mounted on an outer surface of the other of said wing extensions, facing in a direction away from said fuselage.

* * * * *